US012258182B2

(12) United States Patent
Sorbara et al.

(10) Patent No.: US 12,258,182 B2
(45) Date of Patent: Mar. 25, 2025

(54) CLOSURE ASSEMBLY FOR A CONTAINER AND CONTAINER HAVING A CLOSURE ASSEMBLY

(71) Applicant: Tetra Laval Holdings & Finance S.A., Pully (CH)

(72) Inventors: Angelo Sorbara, Rubiera (IT); Rocco De Paola, Modena (IT); Franco Cani, Asti (IT); Pietro Martini, Parma (IT); Tiziano Viani, Bibbiano (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 73 days.

(21) Appl. No.: 17/640,372

(22) PCT Filed: Sep. 15, 2020

(86) PCT No.: PCT/EP2020/075747
§ 371 (c)(1),
(2) Date: Mar. 4, 2022

(87) PCT Pub. No.: WO2021/063669
PCT Pub. Date: Apr. 8, 2021

(65) Prior Publication Data

US 2022/0363447 A1 Nov. 17, 2022

(30) Foreign Application Priority Data

Sep. 30, 2019 (EP) ..... 19200328

(51) Int. Cl.
*B65D 5/74* (2006.01)
*B65D 41/34* (2006.01)
*B65D 55/16* (2006.01)

(52) U.S. Cl.
CPC ..... *B65D 41/3447* (2013.01); *B65D 55/16* (2013.01); *B65D 2401/20* (2020.05)

(58) Field of Classification Search
CPC ..... B65D 41/3447; B65D 41/3428; B65D 41/34; B65D 55/16; B65D 2401/20;
(Continued)

(56) References Cited

U.S. PATENT DOCUMENTS 4,326,639 A 4/1982 Stahl et al.
4,449,639 A * 5/1984 Davis ..... B65D 50/061 215/256

(Continued)

FOREIGN PATENT DOCUMENTS

CN 101460370 A 6/2009
CN 214421197 U 10/2021

(Continued)

OTHER PUBLICATIONS

International Search Report mailed Dec. 21, 2020, for priority International Patent Application No. PCT/EP2020/075747.

(Continued)

*Primary Examiner* — Don M Anderson
*Assistant Examiner* — Elizabeth J Volz
(74) *Attorney, Agent, or Firm* — BUCHANAN INGERSOLL & ROONEY PC

(57) ABSTRACT

There is described a closure assembly for a container filled or fillable with a pourable product. The closure assembly comprises a lid, a first ring member, a second ring member, a coupling element connected to the lid and one of the first ring member and the second ring member, at least one rupturable first coupling bridge connecting the first ring member and the second ring member to one another; and at least one rupturable second coupling bridge connecting the second ring member and the lid to one another.

20 Claims, 8 Drawing Sheets

(58) Field of Classification Search
CPC ..... B65D 2401/30; B65D 2401/15; B65D 51/22; B65D 47/36
USPC ..... 220/265, 266, 375; 206/222; 222/541.2; 215/252, 258, 253, 306, 256
See application file for complete search history.

(56) References Cited

U.S. PATENT DOCUMENTS

| | | | | |
|---|---|---|---|---|
| 4,557,393 | A | 12/1985 | Boik | |
| 9,975,677 | B2 | 5/2018 | Maguire | |
| 2002/0179605 | A1 | 12/2002 | Miani et al. | |
| 2005/0252878 | A1 | 11/2005 | Babcock | |
| 2007/0289937 | A1* | 12/2007 | Kaneko | B65D 5/748 215/252 |
| 2009/0145873 | A1 | 6/2009 | Park | |
| 2012/0285921 | A1 | 11/2012 | Kwon | |
| 2012/0305564 | A1 | 12/2012 | Hayashi | |
| 2013/0043260 | A1 | 2/2013 | Barron | |
| 2015/0251827 | A1 | 9/2015 | Campbell | |
| 2019/0144158 | A1 | 5/2019 | Hauser et al. | |
| 2022/0363447 | A1 | 11/2022 | Sorbara et al. | |

FOREIGN PATENT DOCUMENTS

| | | | | |
|---|---|---|---|---|
| DE | 2910178 | B1 | 6/1980 | |
| DE | 102010028518 | A1 | 11/2011 | |
| EP | 0947433 | A1 | 10/1999 | |
| EP | 1262412 | A1 | 12/2002 | |
| EP | 1902965 | A1 | 3/2008 | |
| EP | 2138416 | A2 | 12/2009 | |
| EP | 3689771 | A1 | 8/2020 | |
| EP | 3715271 | A1 | 9/2020 | |
| JP | 2003026219 | A | 1/2003 | |
| JP | 2004307006 | * | 11/2004 | B65D 41/34 |
| JP | 2004307006 | A | 11/2004 | |
| JP | 2006168765 | A | 6/2006 | |
| JP | 2008001420 | A | 1/2008 | |
| JP | 4447733 | B2 | 4/2010 | |
| JP | 2012158389 | A | 8/2012 | |
| WO | 96/26122 | | 8/1996 | |
| WO | 2002044050 | A1 | 6/2002 | |
| WO | 2005095221 | A1 | 10/2005 | |
| WO | 2007058440 | A1 | 5/2007 | |
| WO | 2009048273 | A2 | 4/2009 | |
| WO | 2017207213 | A1 | 12/2017 | |
| WO | 2018055429 | A1 | 3/2018 | |
| WO | 2020109282 | A1 | 6/2020 | |

OTHER PUBLICATIONS

Directive (EU) 2019/ . . . Of the European Parliament and of the Counsil of on the reduction of the impact of certain plastic products on the environment; Council of the European Union; Jan. 18, 2019; 5483/19.

Proposal for a Directive of the European Parliament and of the Council on the reduction of the impact of certain plastic products on the environment; Council of the European Union; May 29, 2018; 9465/18.

Office Action (Communication pursuant to Rule 114(2) EPC/Third Party Observation) issued on Jul. 2, 2024, in corresponding European Patent Application No. 23170960.1. (9 pages).

Office Action (Communication pursuant to Rule 114(2) EPC/Third Party Observation) issued on Jul. 24, 2024, in corresponding European Patent Application No. 23170960.1. (5 pages).

Office Action (Notice of Reasons for Refusal) issued on Aug. 13, 2024, in corresponding Japanese Patent Application No. 2022-519672 and English translation of the Office Action. (12 pages).

Office Action/Search Report (Notification of the First Office Action) issued on Nov. 23, 2024, in corresponding Chinese Patent Application No. 202011025427.9 and English translation of the Office Action/Search Report. (17 pages).

* cited by examiner

CLOSURE ASSEMBLY FOR A CONTAINER AND CONTAINER HAVING A CLOSURE ASSEMBLY

TECHNICAL FIELD

The present invention relates to a closure assembly for a container, in particular a container filled or fillable with a pourable product, even more particular a container filled or fillable with a pourable food product.

The present invention also relates to a container having a closure assembly.

BACKGROUND ART

As is known, many liquid or pourable food products, such as fruit juice, UHT (ultra-high-temperature treated) milk, wine, tomato sauce, etc., are sold in containers, such as packages made of sterilized packaging material, bottles, cans and the like.

It is furthermore known that often such containers are provided with a closure assembly being provided with a collar delimiting a pouring outlet allowing the outpouring of the pourable product from the container and a lid configured to selectively open and close the pouring outlet and being connected to the collar when closing the pouring outlet.

It is further known that the closure assembly typically also comprises a ring member surrounding the collar and, prior to the first removal of the lid, the ring member and the lid are connected to one another by means of coupling bridges, which rupture during the first removal of the lid from the collar. Thus, the lost connection between the ring element and the lid by means of the ruptured coupling bridges provides a tamper-evidence.

An inconvenience is seen in that the lid is separated from the other portions of the closure assembly and the container when opening the pouring outlet. This means e.g. that a user needs to keep the lid in one hand and the other portions of the closure assembly and the container need to be kept in the other one. Furthermore, such inconvenience may lead to an undesired littering of the lid.

In order to overcome such inconveniences, it has been proposed to hinge the lid to the ring member or to use a tethering element for connecting the ring member and the lid to one another.

While these solutions work well with lids that do not require rotation of the lid for loosening and fastening the lid to the collar, the application of such concepts have not led to the desired results with respect to closure assemblies that require the unscrewing and the screwing of the lid for opening and closing the pouring outlet.

It has also been found that some solutions are such that the lid may disturb a user during the outpouring of the pourable food product.

Therefore, the need is felt in the sector to provide a closure assembly overcoming at least one of the aforementioned inconveniences.

In particular, the need is felt to provide a closure assembly, which guarantees that the lid remains coupled to the container with the pouring outlet being open and to provide a reliable tamper-evidence.

In addition or alternatively, the need is felt to provide a closure assembly, which allows to fasten and loosen the lid to the collar by means of a rotation and to guarantee that the lid remains coupled to the container with the pouring outlet being open and providing for a reliable tamper-evidence.

DISCLOSURE OF INVENTION

It is therefore an object of the present invention to provide in a straightforward and low-cost manner an improved closure assembly for containers, in particular filled or fillable with a pourable product, even more particular filled or fillable with a pourable food product.

It is another object of the present invention to provide in a straightforward and low-cost manner an improved closure assembly for containers, which guarantees the coupling of various portions of the containers to one another during the steps of their use.

It is a further object of the present invention to provide in a straightforward and low-cost manner a container, in particular filled or fillable with a pourable product, even more particular filled or fillable with a pourable food product, having a closure assembly.

According to the present invention, there is provided a closure assembly according to independent claim 1.

Further advantageous embodiments of the closure assembly are specified in the dependent claims.

According to the present invention, there is also provided a container according to claim 16.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
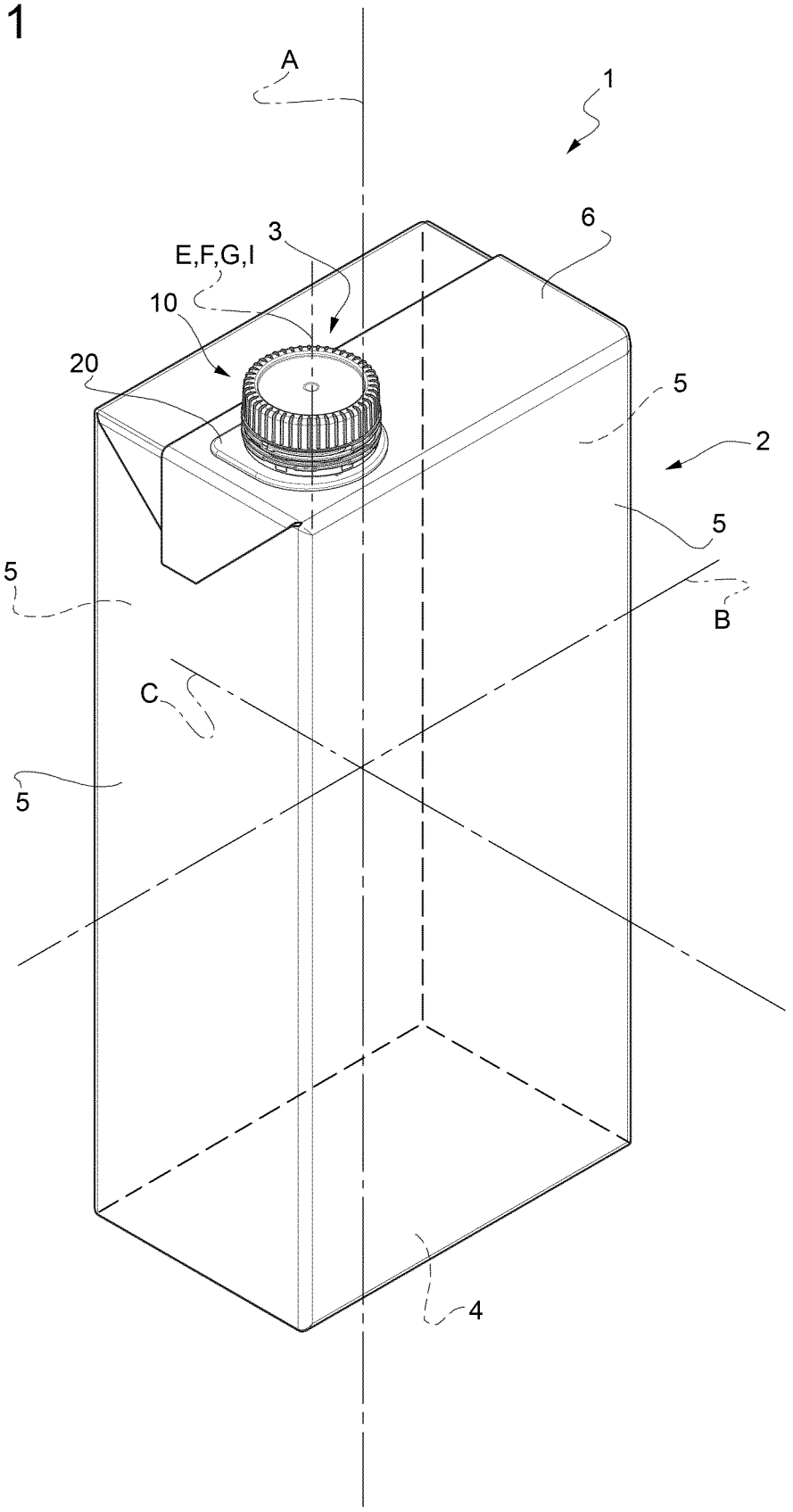
FIG. 1 is a schematic perspective view of a container having a closure assembly according to the present invention and the closure assembly being arranged in a first state, with parts removed for clarity.
Figure 2:
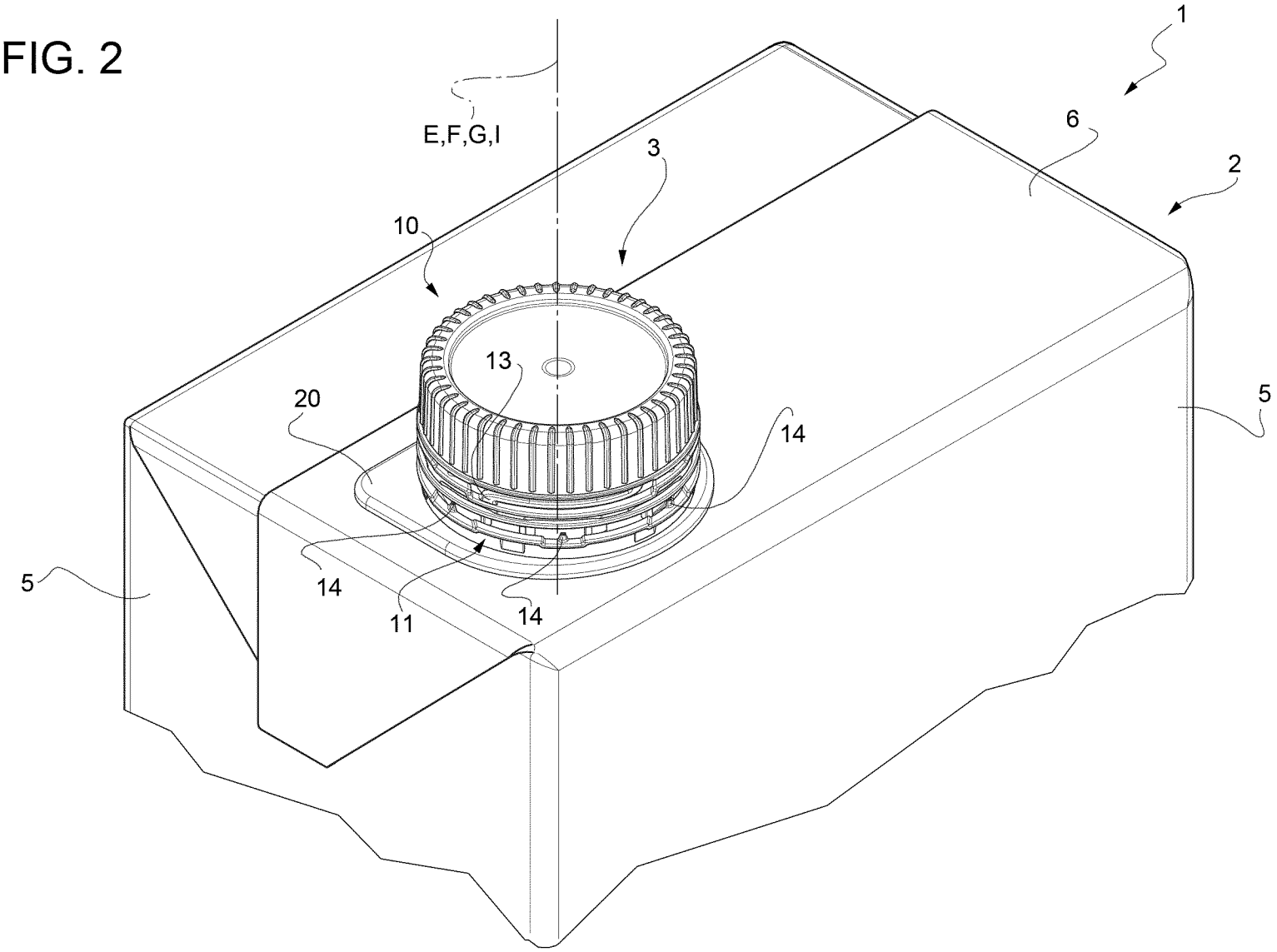
FIG. 2 is a schematic perspective view of a portion of the container of FIG. 1 with the closure assembly being arranged in a second state, with parts removed for clarity.
Figure 3:
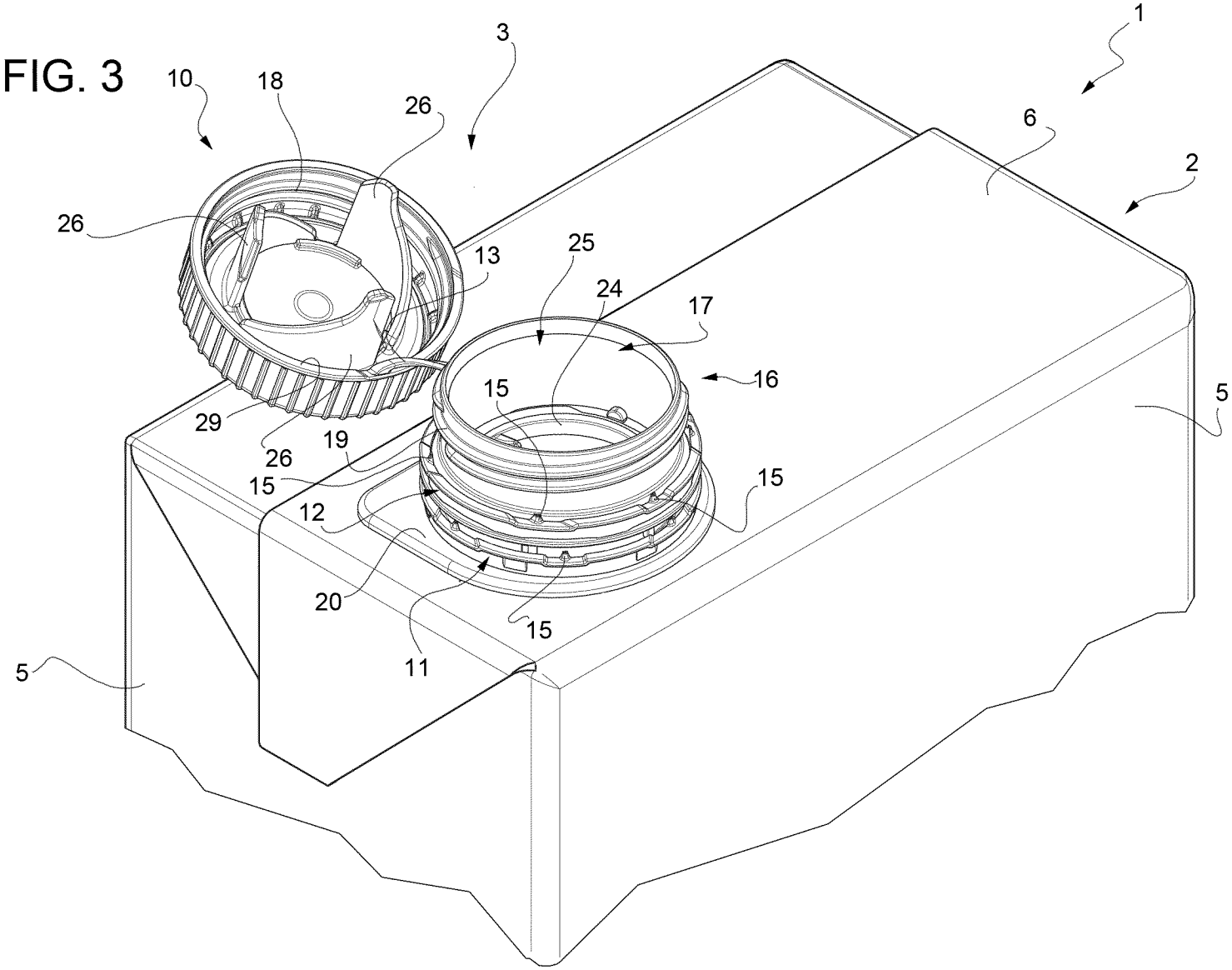
FIG. 3 is a schematic perspective view of a portion of the container of FIG. 1 with the closure assembly being arranged in a third state, with parts removed for clarity.

Number 1 indicates as a whole a container, such as a bottle, a package, a can or the like, comprising a main body 2 and a closure assembly 3 coupled or coupleable to main body 2.

Preferably but not necessarily, container 1 is filled or fillable with a pourable product, in particular a pourable food product, even more particular a sterilized and/or a sterile-processed pourable food product, such as fruit juice, milk (e.g. ultra-high-temperature treated milk), wine, tomato sauce, sugar, salt and others.

The following description will refer to containers 1, in particular main bodies 2, obtained from a web of packaging material having a multilayer structure, although this is in no way intended to limit the scope of protection as defined by the accompanying claims.

In particular, the web of packaging material comprises at least a layer of fibrous material, such as e.g. a paper or cardboard layer, and at least two layers of heat-seal plastic material, e.g. polyethylene, interposing the layer of fibrous material in between one another. One of these two layers of heat-seal plastic material defining the inner face of main body 2 contacting the pourable product.

Preferably but not necessarily, the web of packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, the web of packaging material also comprises a further layer of heat-seal plastic material being interposed between the layer of gas- and light-barrier material and the layer of fibrous material.

According to a preferred non-limiting embodiment, main body 2 defines a sealed package, in particular a sealed carton package, having a designated pour opening surface area (not shown and known as such), and closure assembly 3 is fitted to main body 2 about the designated pour opening surface area.

According to a preferred non-limiting embodiment, closure assembly(ies) 3 is(are) applied to main body(ies) 2 prior, during or after formation, filling and sealing of main body(ies) 2 by means of a molding process and/or adhesive bonding and/or ultrasonic bonding.

Alternatively, closure assembly(ies) 3 can be applied onto the web of packaging material prior to arranging the web of packaging material within or during advancement of the web of packaging material within a packaging machine for forming, filling and sealing main body(ies) 2 from the web of packaging material.

With particular reference to FIG. 1, main body 2 extends along a longitudinal axis A, a first transversal axis B and a second transversal axis C. In particular, longitudinal axis A is perpendicular to first transversal axis B and second transversal axis C and first transversal axis B and second transversal axis C are perpendicular to one another.

Preferentially but not necessarily, the extension of main body 2 along longitudinal axis A is larger than the extension of main body 2 along first transversal axis B and second transversal axis C.

Preferentially but not necessarily, main body 2 is parallelepiped-shaped.

According to the non-limiting embodiment disclosed, main body 2 comprises a first wall portion 4, in particular being transversal, even more particular perpendicular, to longitudinal axis A, from which main body 2 extends along longitudinal axis A. Preferably but not necessarily, first wall portion 4 defines a support surface of container 1, in particular main body 2, which, in use, can be put in contact with a support, such as e.g. a shelf, when, in use, being e.g. exposed within a sales point or when being stored. In particular, when being arranged on a support and/or, in use, during consumption of the pourable food product by a consumer from container 1 first wall portion 4 defines a bottom wall portion.

Preferably but not necessarily, main body 2 also comprises a plurality of lateral walls 5 being (fixedly) connected to first wall portion 4 and extending, in particular substantially parallel to longitudinal axis A, from first wall portion 4.

Preferably but not necessarily, main body 2 also comprises a second wall portion 6 opposite to first wall portion 4 and being (fixedly) connected to lateral walls 5. In other words, lateral walls 5 are interposed between first wall portion 4 and second wall portion 6. In particular, when being arranged on a support and/or, in use, during consumption of the pourable food product by a consumer from container 1, second wall portion 6 defines a top wall portion.

According to some non-limiting embodiments, first wall portion 4 and second wall portion 6 may be parallel to one another.

According to a non-limiting alternative embodiment not shown, first wall portion 4 and second wall portion 6 could be inclined with respect to one another.

According to some non-limiting embodiments, second wall portion 6 comprises the designated pour opening surface area.

According to a preferred non-limiting embodiment, the designated pour opening surface area of main body 2 comprises a pouring hole allowing for the outflow of the pourable product from main body 2.

According to a preferred non-limiting embodiment, the designated pour opening surface area also comprises a separation membrane sealing the pouring hole. In particular, the separation membrane is configured to retain the pourable product within main body 2 when being intact and to be at least partially (and non-reversibly) openable and/or rupturable and/or cuttable and/or piercable so as to allow the outflow of the pourable product from main body 2 through at least a portion of the pouring hole. In particular, the separation membrane is configured to allow the outflow of the pourable product after its loss of integrity and to protect the pourable product from the outer environment prior to its cutting and/or opening and/or rupturing and/or piercing.

Preferentially but not necessarily, the separation membrane comprises a gas- and light-barrier material, e.g. aluminum foil or ethylene vinyl alcohol (EVOH) film.

According to a preferred non-limiting embodiment, the separation membrane is defined by a portion of the web of packaging material, in particular a portion of the layers of the web of packaging material being different from the layer of fibrous material.

According to a preferred non-limiting embodiment, closure assembly 3 comprises and/or is formed from a polymeric material. In alternative, closure assembly 3 could comprise and/or is formed from a metallic material.

With particular reference to FIGS. 1 to 9, closure assembly 3 comprises at least:

- a lid 10;
- a first ring member 11;
- a second ring member 12, in particular coaxial to first ring member 11; and
- a coupling element 13 connected to lid 10 and to one of first ring member 11 and second ring member 12, in the specific case shown coupling element 13 is connected to lid 10 and second ring member 12.

Advantageously, closure assembly 3 also comprises:

one or more rupturable first coupling bridges 14 connecting first ring member 11 and second ring member 12 with one another; and one or more rupturable second coupling bridges 15 connecting second ring member 12 and lid 10 with one another.

It should be noted that coupling element 13 is connected to lid 10 and first ring member 11 or second ring member 12 in a non-rupturable manner and/or separation resistant manner. This means that upon a normal use of closure assembly 3 coupling element 13 remains connected to lid 10 and first ring member 11 or second ring member 12. In particular, the respective connections between lid 10 and first ring member 11 or second ring member 12 are designed to resist an acting force, which exceeds the forces that typically act during a normal use of closure assembly 3. An example of the occurrence of such an exceeding acting force is the case when a user intends to willingly detach coupling element 13 from lid 10 and/or first ring member 11 or second ring member 12 by pulling lid 10 and first ring member 11 and/or second ring member 12 along different directions from one another.

According to a preferred non-limiting embodiment, coupling element 13 is string-shaped.

In alternative, coupling element 13 could have any other shape (e.g. being an endless coupling element) and/or closure assembly 3 comprises more than one coupling element 13 and/or coupling clement 13 comprises different portions being connected to lid 10 and/or first ring member 11 and/or second ring member 12.

Advantageously, each first coupling bridge 14 is arranged in a respective non-ruptured configuration when being connected to first ring member 11 and second ring member 12 and a respective ruptured configuration when being ruptured (i.e. the respective first coupling bridge 14 is disconnected from first ring member 11 and/or second ring member 12.

Advantageously, each second coupling bridge 15 is arranged in a respective non-ruptured configuration when being connected to second ring member 12 and lid 10 and a respective ruptured configuration when being ruptured (i.e. the respective second coupling bridge 15 is disconnected from second ring member 12 and/or lid 10).

In particular, the non-ruptured configuration of each first coupling bridge 14 and each second coupling bridge 15 is the respective initial configuration (i.e. a user handling container 1 for the first time, finds first coupling bridges and second coupling bridges 15 in their non-ruptured configuration) and the control from the respective non-ruptured configuration to the respective ruptured configuration is irreversible.

In particular, first coupling bridges 14 and second coupling bridges 15 are designed to define at least an initial state of closure assembly 3 in which first coupling bridges 14 and second coupling bridges 15 are arranged in the respective non-ruptured configuration (i.e. first coupling bridges 14 and second coupling bridges 15 are connected to respectively first ring member 11 and second ring member 12 and to lid 10 and second ring member 12). In particular, closure assembly 3, when being in the initial state is intact (i.e. no manipulation or use of closure assembly 3 has been initiated or tried). In other words, the state of closure assembly 3 corresponds to the one in which closure assembly 3 was applied to main body 2.

According to a preferred non-limiting embodiment, closure assembly 3 is arranged in a manipulated state with first coupling bridges 14 and second coupling bridges 15 being arranged in the respective ruptured configurations (i.e. lid 10 is disconnected from second ring member 12 by means of second coupling bridges 15 (while still being connected by means of coupling element 13) and first ring member 11 and second ring member 12 are disconnected from one another).

According to a preferred non-limiting embodiment, each first coupling bridge 14 is designed to rupture at a force being equal or larger than a first rupturing force and each second coupling bridge 15 is designed to rupture at a force being equal or larger than a second rupturing force. In particular, the first rupturing force is smaller than the second rupturing force. In this way, it is guaranteed that in use, during a manipulation of closure assembly 3, first coupling bridges 14 rupture prior to second coupling bridges 15.

In particular, at least first ring member 14 acts as a tamper-evidence or in other words, first ring member 14 is designed as a tamper-evidence element.

Preferentially but not necessarily, also second ring member 15 acts as a tamper-evidence.

Preferentially but not necessarily, closure assembly 3 is in an intermediate state with first coupling bridges 14 being arranged in the ruptured configuration ad second coupling bridges 15 being arranged in the non-ruptured configuration.

As will be explained further below in more detail, in use, during a first manipulation of closure assembly 3, closure assembly 3 is at first controlled from the initial state to the intermediate state and then from the intermediate state to the manipulated state.

According to some non-limiting embodiments, closure assembly 3 also comprises a collar 16 delimiting and/or defining a pouring outlet 17 (of container 1), the pouring outlet 17 being configured to allow for the outflow of the pourable product from container 1.

In particular, first ring member 11 and second ring member 12 are coupled to and surround collar 16; and lid 10 is connected and/or connectable to collar 16 and is configured to selectively close and open pouring outlet 17 for respectively impeding and allowing the outflow of the pourable product from container 1 through pouring outlet 17.

According to some non-limiting embodiments, first ring member 11 and second ring member 12 are coaxial to collar 16.

According to some non-limiting embodiments, first ring member 11 and/or second ring member 12 is/are coupled to collar 16 in a rotatable manner around respectively a rotation axis E and a rotation axis F, and in particular around collar 16. In particular, rotation axis E and rotation axis F being transversal to first transversal axis B and second transversal axis C.

According to some non-limiting embodiments, lid 10 and collar 16 are designed such that lid 10 can be fastened to and loosened from collar 16 by means of rotation (by means of respectively screwing and unscrewing) of lid 10 with respect to collar 16 around a rotation axis G. In particular, rotation axis G being transversal to first transversal axis B and second transversal axis C.

Preferentially but not necessarily, lid 10 comprises an inner threaded portion 18, in particular arranged at an inner surface of lid 10, and collar 16 comprises an outer threaded portion 19, in particular arranged at an outer surface of collar 16. Inner threaded portion 18 and outer threaded portion 19 are configured to allow for selectively fastening and loosening lid 10 to and from collar 16 by means of a relative rotation between lid 10 and collar 16.

According to some non-limiting embodiments, closure assembly 3 further comprises a coupling base 20 carrying collar 16 and being configured to couple and/or connect (see FIGS. 4 to 6) and/or being coupled and/or connected to (see FIGS. 1 to 3) main body 2.

Preferentially but not necessarily, coupling base 20 is configured to be fixed and/or is fixed to an outer surface of main body 2, in particular of second wall portion 6. In particular, coupling base 20 is arranged in the area of, even more particular at, the designated pour opening surface area.

In particular, coupling base 20 comprises an opening, in particular a circular opening, and collar 16 surrounds the opening so that, in use, with the separation membrane being opened and/or cut and/or ruptured and/or pierced a fluid connection between the inside of main body 2 and pouring outlet 17 is established (i.e. the pourable product can flow out of container 1).

Preferentially but not necessarily, at least a portion of coupling base 20 (substantially) has a plate-like configuration.

Preferentially but not necessarily, collar 16 extends, in particular from coupling base 20, along, in particular parallel to, a longitudinal axis I, in particular longitudinal axis I being a central axis of collar 16. In particular, the opening of coupling base 20, collar 16 and the pouring hole are coaxial to one another.

Preferentially but not necessarily, rotation axis G and longitudinal axis I are parallel, in particular coaxial, to one another.

According to a preferred non-limiting embodiment, collar 16 has a circular shape, in particular a circular cross-sectional shape with respect to a sectional plane being orthogonal to longitudinal axis I.

Figure 4:
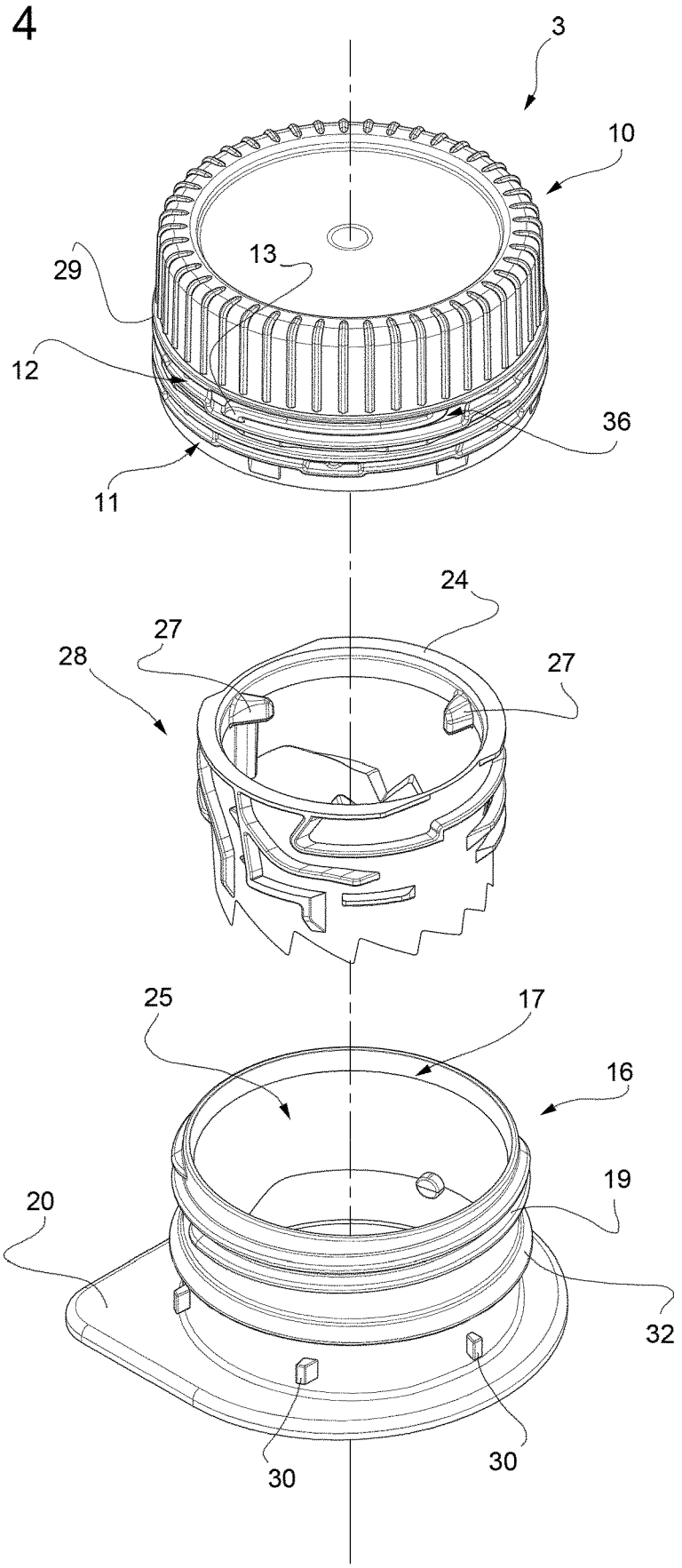
FIG. 4 is an exploded view of the closure assembly of FIGS. 1 to 3, with parts removed for clarity.
Figure 5:
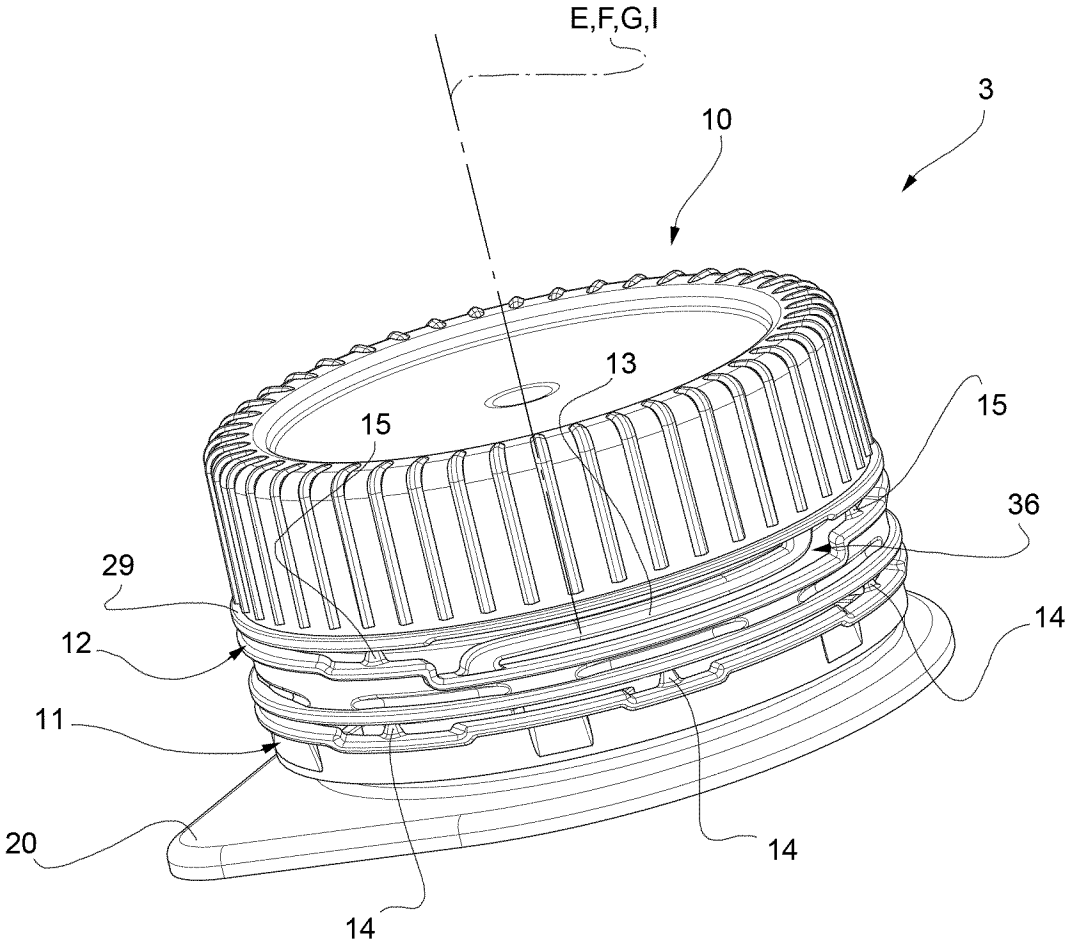
FIG. 5 is an enlarged perspective view of details of the closure assembly of FIGS. 1 to 3 being in the first state, with parts removed for clarity.
Figure 6:
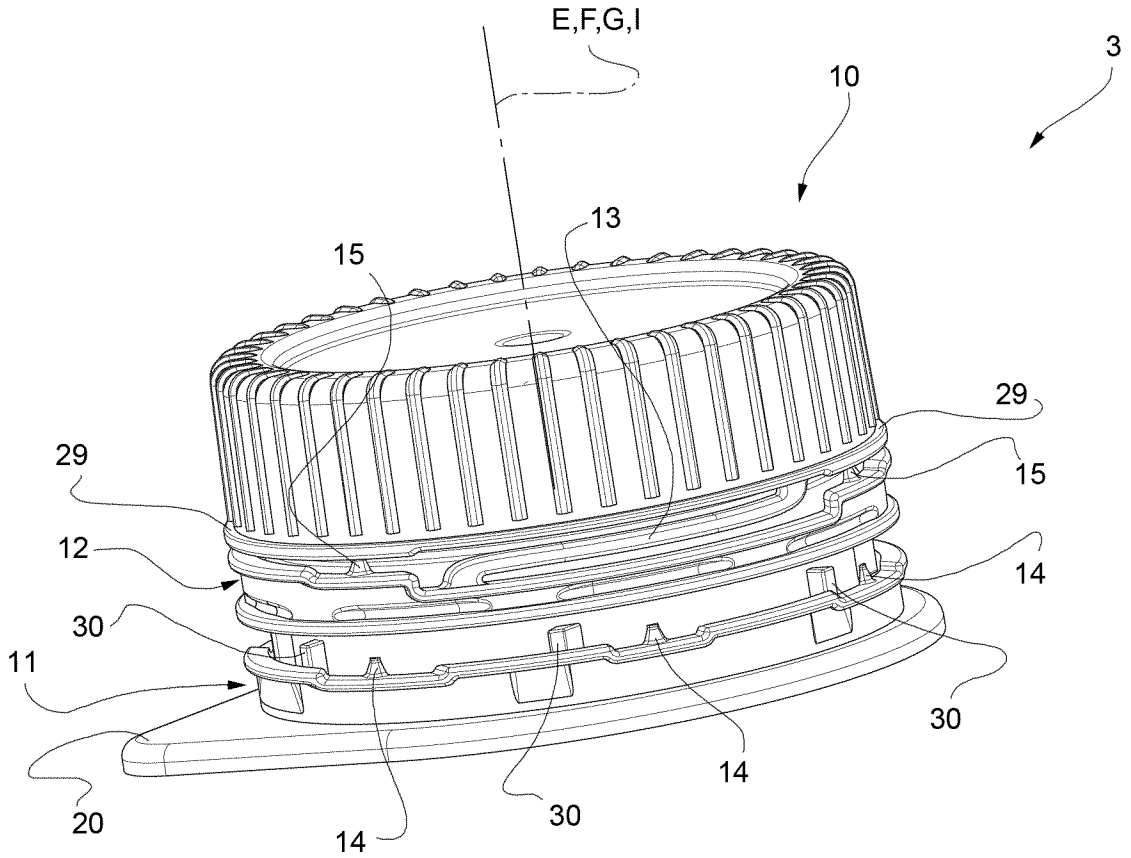
FIG. 6 is an enlarged perspective view of details of the closure assembly of FIGS. 1 to 3 being in the second state, with parts removed for clarity.
Figure 7:
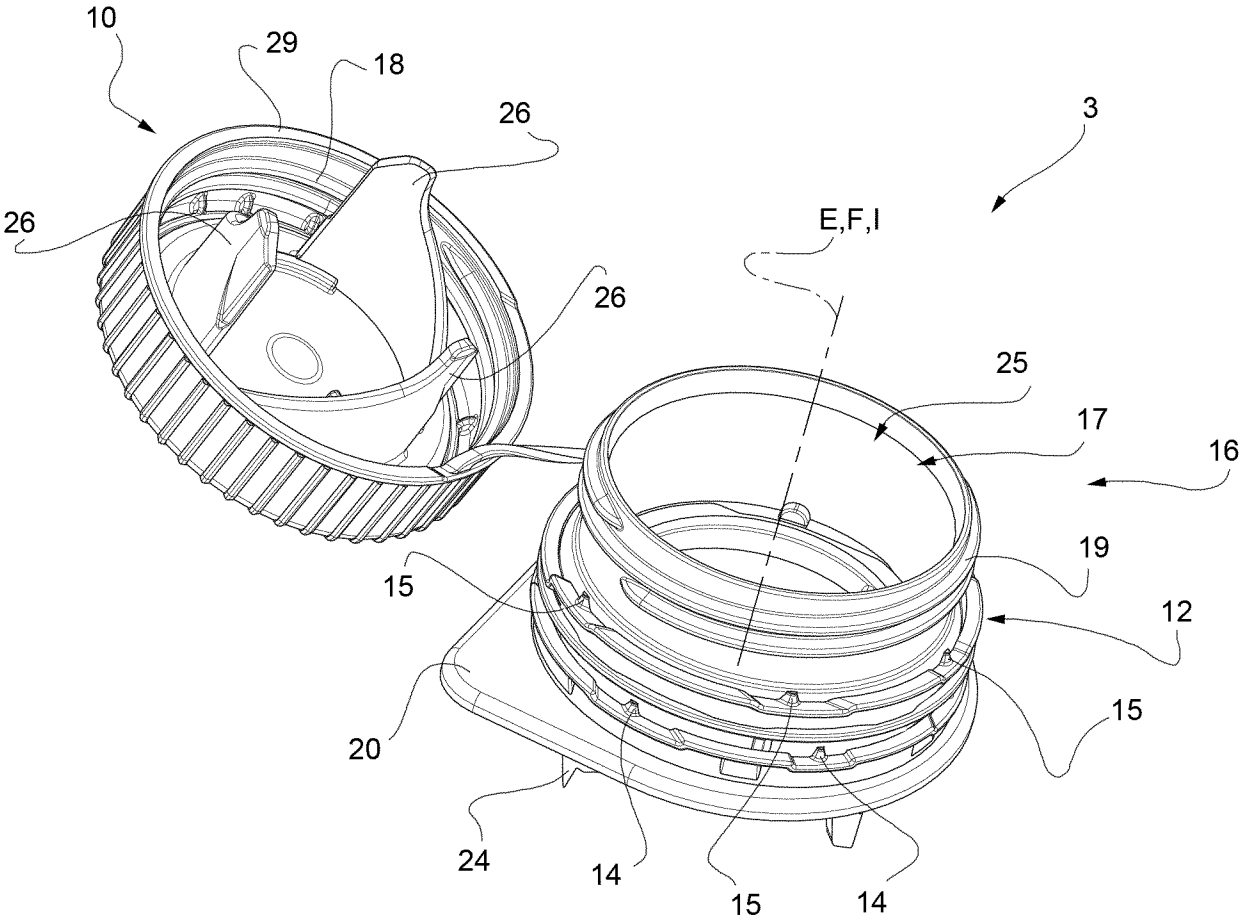
FIG. 7 is an enlarged perspective view of details of the closure assembly of FIGS. 1 to 3 being in the third state, with parts removed for clarity.

According to some non-limiting embodiments and with particular reference to FIG. 4, closure assembly 3 also comprises a cutting device 24 configured to rupture and/or pierce and/or cut and/or open the separation membrane and a control device configured to control cutting device 24 from a rest position to an operative position in which cutting device 24 is adapted to rupture and/or pierce and/or cut and/or open the separation membrane.

Preferentially but not necessarily, cutting device 24 has an annular shape and is arranged within an inner space 25 of collar 16 when being arranged in the rest position and protrudes at least partially out of inner space 25 when being controlled in the operative position.

In particular, cutting device 24 is arranged in the rest position with closure assembly 3 being arranged in the initial state and is arranged in the operative position with closure assembly 3 being arranged in the manipulated state.

Preferentially but not necessarily, cutting device 24 is, in use, controlled by means of the control device from the rest configuration to the operative configuration during control of closure assembly 3 from the intermediate state to the manipulated state.

Preferentially but not necessarily, cutting device 24 is in an axially raised position (with respect to longitudinal axis I) when being arranged in the rest position and with respect to the operative position.

According to some non-limiting embodiments, the control device comprises control flaps 26, in particular connected to lid 10, interaction elements 27 connected to cutting device 24 and a cam mechanism 28 (see FIG. 4; known as such and not described in detail) partially associated to cutting device 24 and partially associated to collar 16.

In particular, control flaps 26 are configured to and/or protrude into inner space 25.

Preferentially but not necessarily, control flaps 26 are connected to and protrude away from an inner surface portion of lid 10.

Preferentially but not necessarily, the control device is actuatable through rotation of control flaps 26 around a respective rotation axis, in particular by means of rotation of lid 10 around rotation axis G. In particular, rotation of control flaps 26 leads, in use, to a rototraslatory movement of cutting device 24, which is guided by means of cam mechanism 28.

According to some preferred non-limiting embodiments, lid 10 is controllable in at least a first operative configuration (see FIGS. 1, 2, 5 and 6) in which lid 10 is coaxial to first ring member 11 and/or second ring member 12 and a second operative configuration (see FIGS. 3 and 7) in which lid 10 is transversally arranged with respect to first ring member 11 and/or second ring member 12.

In particular, lid 10 is configured to close and open pouring outlet 17 with lid 10 being controlled in respectively the first operative configuration and the second operative configuration.

Preferentially but not necessarily, lid 10 is controlled in the first operative configuration and the second operative configuration with lid 10 itself being respectively connected to and detached from collar 16. In particular, lid 10 is coaxial to collar 16 when being controlled in the first operative configuration and preferentially but not necessarily is transversal to collar 16 when being controlled in the second operative configuration. In other words, when lid 10 is arranged in the first operative configuration lid 10 is connected to collar 16 and covers pouring outlet 17 and when lid 10 is arranged in the second operative configuration lid 10 is detached from collar 16 and clears pouring outlet 17.

In particular, a ring portion 29 of lid 10 is parallel to and transversal to ring member 11 when being controlled in respectively the first operative configuration and the second operative configuration. This latter reflects the fact that lid 10 needs to be distanced and/or separated from first ring member 11 and/or second ring member 12 for allowing the outflow of the pourable product through pouring outlet 17 (see e.g. FIGS. 3 and 7).

Preferentially but not necessarily, coupling element 13 is connected to ring portion 29.

Preferentially but not necessarily, second ring member 12 is interposed between lid 10 and first ring member 11 with lid 10 being controlled in the first operative configuration.

In particular, lid 10 is arranged in the first operative configuration with closure assembly 3 being controlled in the initial state.

In particular, closure assembly 3, in particular lid 10, first ring member 11, second ring member 12, first coupling bridges 14 and second coupling bridges 15 are designed such that the first time lid 10 is controlled from the first operative configuration, closure assembly 3 is controlled from the initial state to the manipulated state, in particular from the initial state to the intermediate state and from the intermediate state to the manipulated state.

It should be noted that preferably but not necessarily, while the control of closure assembly 3 from the initial state to the intermediate state and/or manipulated state is irreversible, the control of lid 10 from the first operative configuration to the second operative configuration is reversible (i.e. lid 10 can be controlled between the first operative configuration and the second operative configuration a plurality of times).

According to some non-limiting embodiments, the control device is configured to move cutting device 24 from the rest position to the operative position when, in use, closure assembly 3 is in the initial state and during control of lid 10 from the first operative configuration to the second operative configuration.

Preferentially but not necessarily, control flaps 26 protrude into and are removed from inner space 25 with lid 10 being arranged in respectively the first operative configuration and the second operative configuration.

According to some non-limiting embodiments, lid 10 is configured to be controlled between the first operative configuration and the second operative configuration by means of a relative rotation of lid 10 around rotation axis G. In particular, inner threaded portion 18 and outer threaded portion 19 are configured to guide the control of lid 10 between the first operative configuration and the second operative configuration.

In particular, lid 10 is controlled, in use, from the first operative configuration to the second operative configuration and from the second operative configuration to the first operative configuration by rotation of lid 10 around rotation axis G in, respectively, a first sense of rotation and a second sense of rotation opposite to the first sense of rotation.

According to a preferred non-limiting embodiment, first ring member 11 and second ring member 12 are axially displaced (with respect to rotation axis G and/or longitudinal axis I) from one another.

In particular, first ring member 11 is interposed between second ring member 12 and coupling base 20.

Figure 8:
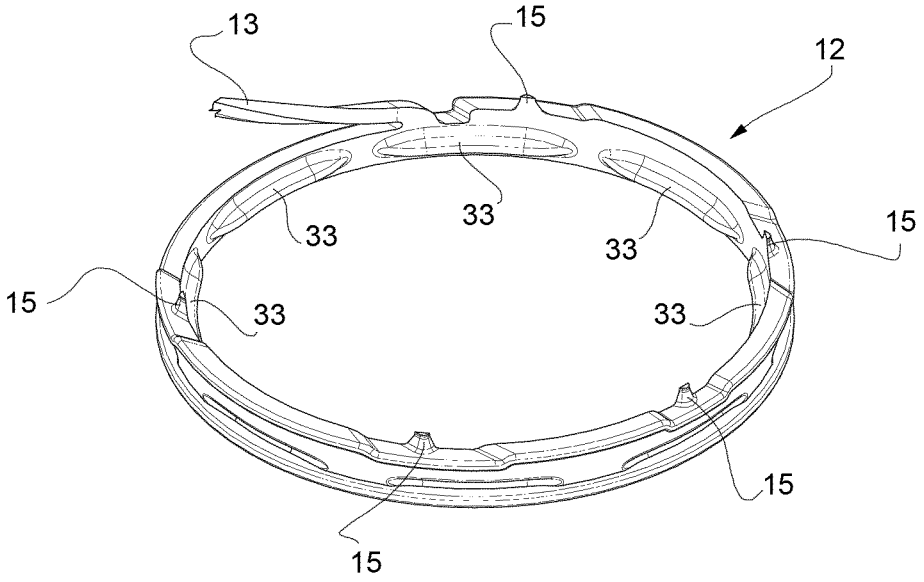
FIG. 8 is a perspective view of a portion of the closure assembly of FIGS. 1 to 3, with parts removed for clarity.
Figure 9:
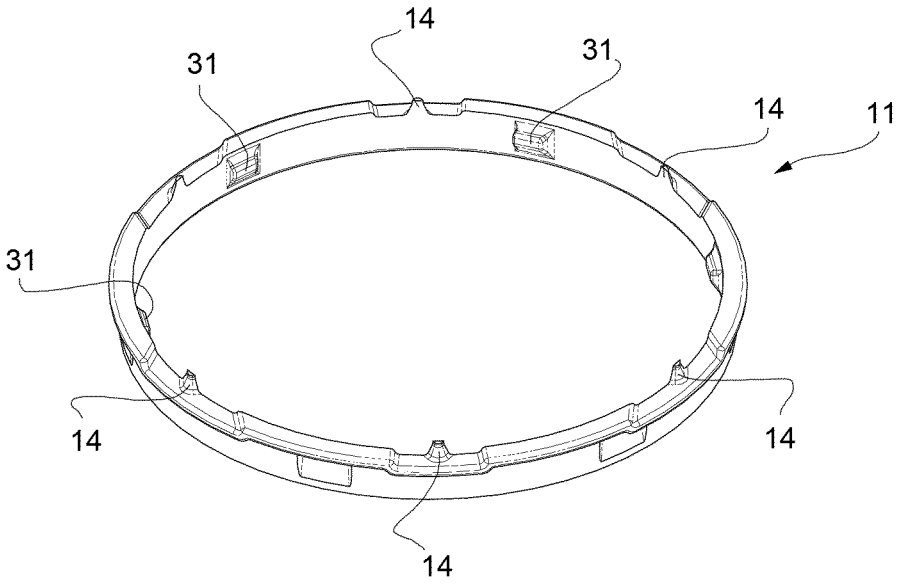
FIG. 9 is a perspective view of another portion of the closure assembly of FIGS. 1 to 3, with parts removed for clarity.

With particular reference to FIGS. 4, 8 and 9, closure assembly 3 further comprises:

- a first rupturing device configured to actuate a non-reversible rupturing of first coupling bridges 14 during control of closure assembly 3 from the initial state to the manipulated state, in particular to the intermediate state and also; and
- a second rupturing device configured to actuate a non-reversible rupturing of second coupling bridges 15 during control of closure assembly 3 from the initial state to the manipulated state, in particular from the initial state to the intermediate state to the manipulated state.

In particular, the first rupturing device and the second rupturing device are activated during control of lid 10 from the first operative configuration to the second operative configuration, in particular by means of rotation of lid 10 around rotation axis G.

According to a preferred non-limiting embodiment, the first rupturing device and the second rupturing device are configured such that first coupling bridges 14 rupture prior to second coupling bridges 15 during control of closure assembly 3 from the initial state to the manipulated state.

In particular, the first rupturing device is activated, in use, during control of closure assembly 3 from the initial state to the intermediate state and the second rupturing device is activated, in use, during control of closure assembly 3 from the intermediate state to the manipulated state.

In particular, the first rupturing device is configured to create a force which equals or is larger than the first rupturing force and which is lower than the second rupturing force, while the second rupturing device is configured to create a force, which equals or is larger than the second rupturing force.

With particular reference to FIGS. 4 and 9, the first rupturing device comprises one or more first interaction elements 30 associated to and/or carried by collar 16 and one or more second interaction elements 31 associated to and/or carried by first ring member 11. In particular, each second interaction element 31 is configured to abut against one respective first interaction element 30 for actuating the non-reversible rupturing of first coupling bridges 14. Even more particular, each second interaction element 31 and the respective first interaction element 30 are designed such that the second interaction element 31 abuts, in use, against the respective first interaction element 30 upon a relative rotation of first ring member 11 (around rotation axis E and) with respect to collar 16.

Preferentially but not necessarily, each second interaction element 31 and the respective first interaction element 30 are arranged such that each second interaction element 31 abuts, in use, against the respective first interaction element 30 within a relative angular movement of first ring member 11 with respect to first interaction elements 30 of at most 20°.

Preferentially but not necessarily, first interaction elements 30 are connected to an outer surface of collar 26 and radially protrude away from collar 26. In particular, first interaction elements 30 are equally spaced around longitudinal axis I.

Preferentially but not necessarily, second interaction elements 31 are connected to an inner surface of first ring member 11 facing the outer surface of collar 16 and radially protrude away from first ring member 11. In particular, second interaction elements 31 are equally spaced around rotation axis E.

With particular reference to FIGS. 4 and 8, the second rupturing device comprises at least one first interaction member 32 associated to and/or carried by collar 16 and one or more second interaction members 33 associated to and/or carried by second ring member 12.

According to a preferred non-limiting embodiment, each second interaction member 33 is configured to abut against at least one respective portion of first interaction member 32 for actuating the non-reversible rupturing of second coupling bridges 15. In particular, each second interaction member 33 and the respective first interaction member 32 are designed such that each second interaction element 33 abuts, in use, against at least a respective portion of first interaction member 32 upon a relative axial movement of second ring member 12 with respect to first interaction member 32 and/or collar 16. Even more particular, the relative axial movement is actuated by means of rotation of lid 10 around rotation axis G and the interaction between inner threaded portion 18 and outer threaded portion 19.

Preferentially but not necessarily, second interaction members 33, first interaction member 32 and inner threaded portion 18 and outer threaded portion 19 are arranged such that second interaction members 33 abut, in use, against the respective portions of first interaction member 32 within a relative angular movement of lid 10 around rotation axis G of at least 20° and of at most 45°.

Preferentially but not necessarily, first interaction member 32 is connected to the outer surface of collar 26 and radially protrudes away from collar 26. In particular, first interaction member 32 comprises a ring element connected to and surrounding collar 16 in a non-rotatable manner. Even more particular, the ring element is integral to collar 16.

Preferentially but not necessarily, first interaction member 32 is axially displaced (with respect to longitudinal axis I and) with respect to first interaction elements 30. In particular, first interaction elements 30 are interposed between first interaction member 32 and coupling base 20.

Preferentially but not necessarily, second interaction members 33 are connected to an inner surface of second ring member 12 facing the outer surface of collar 16 and radially protrude away from second ring member 12. In particular, second interaction members 33 are equally spaced around rotation axis F.

According to the non-limiting embodiment shown, second interaction members 33 are in the form of flaps protruding from the inner surface of second ring member 12.

According to a preferred non-limiting embodiment, second ring member 12 comprises a recess 36 for hosting at least a portion of coupling element 13 and second ring member 12 and lid 10 are axially spaced from another such to host another portion of coupling element 13 with closure assembly 3 being in the first operative configuration.

In use, a user needs to execute a first step of controlling, during which closure assembly 3 is controlled from the initial state to the manipulated state (prior to a step of outpouring of the pourable product from container 1).

In particular, during the first step of controlling, closure assembly 3 is controlled such that first coupling bridges 14 and second coupling bridges 15 rupture, while lid 10 and second ring member 12 remain connected to one another by means of coupling element 13.

Even more particular, during the first step of controlling, at first closure assembly 3 is controlled from the initial state to the intermediate state followed by the control of closure assembly 3 from the intermediate state to the manipulated state.

Preferentially but not necessarily, during the control from the initial state to the intermediate state first coupling bridges 14 rupture disconnecting first ring member 11 and second ring member 12 from one another and during the control from the intermediate state to the manipulated state second coupling bridges 15 rupture so that second ring member 12 and lid 10 remain connected to one another only by means of coupling element 13.

According to a preferred non-limiting embodiment, during the first step of controlling, at first the first rupturing device is activated followed by the activation of the second rupturing device.

According to a preferred non-limiting embodiment, during the first step of controlling a second step of controlling is executed, during which lid 10 is controlled from the first operative configuration to the second operative configuration.

Preferentially but not necessarily, during the second step of controlling, lid 10 is (reversibly) controlled form the first operative configuration to the second operative configuration by means of rotation of lid 10 around rotation axis G and/or collar 16.

Preferentially but not necessarily, during the first step of controlling and during the second step of controlling, control of lid 10 from the first operative configuration to the second operative configuration actuates (at first) the first rupturing device and (then) the second rupturing device for rupturing respectively the first coupling bridges 14 and the second coupling bridges 15.

In particular, during the first step of controlling and during the second step of controlling and during the rotation of lid 10 around rotation axis E both first ring member 11 and second ring member 12 rotate around respectively rotation axis E and rotation axis F due the connection of lid 10 and second ring member 12 by means of coupling element 13 and second coupling bridges 15 and the connection of second ring member 12 and first ring member 11 by means of first coupling bridges 14.

According to a preferred non-limiting embodiment, the rotation of first ring member 11 results in a relative angular movement between each second interaction element 31 and the respective first interaction element 30 until each second interaction element 31 abuts against the respective first interaction element 30, leading to the establishment of the first rupturing force and the rupturing of first coupling bridges 14. This also means that any further rotation of lid 10 is not transferred to first ring member 11.

According to a preferred non-limiting embodiment, during the first step of controlling and during the second step of controlling and during the rotation of lid 10 around rotation axis E second ring member 12 is (together with lid 10) also axially displaced, in particular due to the interaction between inner threaded portion 18 and outer threaded portion 19, resulting in a relative axial movement between second interaction members 33 and first interaction member 32 until each second interaction member 33 abuts against the respective portion of first interaction member 32, leading to the establishment of the second rupturing force and the rupturing of second coupling bridges 15. This also means that any further rotation of lid 10 is transferred to second ring member 12 by means of coupling element 13 only. In particular, during further control steps of lid 10 between the first operative configuration and the second operative configuration, second ring member 12 rotates around rotation axis F.

According to a preferred non-limiting embodiment, during the first step of controlling and/or the second step of controlling, cutting device 24 is activated for rupturing and/or cutting and/or piercing and/or opening the separation membrane.

The advantages of closure assembly 3 according to the present invention will be clear from the foregoing description.

In particular, lid 10 is coupled to container 1 independently on whether lid 10 is controlled in the first operative configuration or the second operative configuration or any configuration intermediate to both. At the same time first ring member 11 clearly allows for a tamper evidence as additionally also the second coupling bridges 15 indicate a tampering.

Another advantage has been identified in that the production of closure assemblies 3 can be realized relying on molds similar to the one known requiring only minor modifications.

An even other advantage resides in that the gradual control of closure assembly 3 from the initial state to the intermediate state and from the intermediate state to the manipulated state also allows to understand whether cutting device 24 has already cut and/or opened and/or pierced and/or ruptured the separation membrane. Indeed, cutting device 24 only starts to interact with the separation membrane after the control of closure assembly 3 in the intermediate state. Thus, a user understands from the unbroken second coupling bridges 15 that the separation membrane is still intact.

A further advantage resides in that coupling element 13 allows to control the relative position and the distance between lid 10 and second ring member 12 in a flexible manner.

Clearly, changes may be made to container 1 and/or closure assembly 3 as described herein without, however, departing from the scope of protection as defined in the accompanying claims.

The invention claimed is:

1. A closure assembly for a container filled or fillable with a pourable product, the closure assembly being manipulatable from an initial state to a manipulated state;

the closure assembly comprises:

a lid;

a first ring member;

a second ring member;

a coupling element connected to the lid and to one of the first ring member and the second ring member;

at least one rupturable first coupling bridge connecting the first ring member and the second ring member to one another in the initial state of the closure assembly, the at least one rupturable first coupling bridge being rupturable as the closure assembly is manipulated to the manipulated stated so that the at least one rupturable first coupling bridge is ruptured and the first and second ring members are completely disconnected from each other; and at least one rupturable second coupling bridge connecting the second ring member and the lid to one another in the initial state of the closure assembly, the at least one rupturable second coupling bridge being rupturable as the closure assembly is manipulated to the manipulated stated so that the lid and the second ring member are no longer connected to each other by way of the at least one rupturable second coupling bridge while the lid remains connected to the one of the first ring member and the second ring member by way of the coupling element.

2. The closure assembly according to claim 1, wherein the first coupling bridge is designed to rupture at a force being equal or larger than a first rupturing force and the second coupling bridge is designed to rupture at a force being equal or larger than a second rupturing force;

wherein the first rupturing force is smaller than the second rupturing force.

3. The closure assembly according to claim 1, wherein the second ring member is interposed between the lid and the first ring member.

4. The closure assembly according to claim 1, wherein at least the first ring member is designed as a tamper-evidence element.

5. The closure assembly according to claim 1, wherein the closure assembly is controllable in the initial state with the first coupling bridge and the second coupling bridge being connected respectively to the first ring member and the second ring member and to the second ring member and the lid; and the manipulated state at which the first coupling bridge and the second coupling bridge are ruptured;

wherein the closure assembly further comprises:

a first rupturing device configured to actuate a non-reversible rupturing of the first coupling bridge during control of the closure assembly from the initial state to the manipulated state; and a second rupturing device configured to actuate a non-reversible rupturing of the second coupling bridge during control of the closure assembly from the initial state to the manipulated state.

6. The closure assembly according to claim 5, wherein the closure assembly is also controllable in an intermediate state in which the first coupling bridge is ruptured and the second coupling bridge is connected to the second ring member and the lid;

wherein the first rupturing device is configured to actuate the non-reversible rupturing of the first coupling bridge during control of the closure assembly from the initial state to the intermediate state; and the second rupturing device is configured to actuate the non-reversible rupturing of the second coupling bridge during control of the closure assembly from the intermediate state to the manipulated state.

7. The closure assembly according to claim 5, wherein the lid is controllable between at least a first operative configuration in which the lid is coaxial to the first ring member and/or the second ring member and a second operative configuration in which the lid is transversally arranged to the first ring member and/or the second ring member;

wherein the lid is in the first operative configuration when the closure assembly is in the initial state;

wherein the first rupturing device and the second rupturing device are configured such that the first coupling bridge ruptures prior to the second coupling bridge during control of the lid from the first operative configuration to the second operative configuration.

8. The closure assembly according to claim 5, and further comprising a collar delimiting a pouring outlet;

wherein the first ring member and the second ring member are coupled to and surround the collar.

9. The closure assembly according to claim 8, wherein the lid comprises an inner threaded portion and the collar comprises an outer threaded portion;

wherein the inner threaded portion and the outer threaded portion are configured to allow for selectively fastening and loosening the lid on the collar.

10. The closure assembly according to claim 1, and further comprising a cutting device configured to rupture and/or pierce and/or cut and/or open a separation membrane of the container.

11. The closure assembly according to claim 1, wherein the connecting element is connected to the lid and the second ring member.

12. A container for a pourable product comprising at least one main body being filled or being fillable with the pourable product and at least one closure assembly according to claim 1 and being coupled to the main body.

13. The closure assembly according to claim 1, wherein the first ring member and the second ring member are coaxial both: i) before the at least one rupturable first coupling bridge and the at least one rupturable second coupling bridge are ruptured; and ii) after the at least one rupturable first coupling bridge and the at least one rupturable second coupling bridge are ruptured.

14. A closure assembly for a container filled or fillable with a pourable product, the closure assembly being manipulatable from an initial state to a manipulated state, the closure assembly comprising:

a lid;

a pair of ring-shaped members;

a coupling element connecting the lid to one of the ring-shaped members;

the pair of ring-shaped members including a first rotatable ring-shaped member and a second rotatable ring-shaped member;

at least one rupturable first coupling bridge connecting the first ring-shaped member and the second ring-shaped member to one another in the initial state of the closure assembly, the at least one rupturable first coupling bridge being rupturable as the closure assembly is manipulated to the manipulated stated so that the at least one rupturable first coupling bridge is ruptured and the first ring-shaped member is rotatable relative to the second ring-shaped member; and the first ring-shaped member and the second ring-shaped member being configured to remain ring-shaped after the at least one rupturable first coupling bridge is ruptured.

15. The closure assembly according to claim 14, further comprising at least one rupturable second coupling bridge connecting the second ring-shaped member and the lid to one another in the initial state of the closure assembly, the at least one rupturable second coupling bridge being rupturable as the closure assembly is manipulated to the manipulated stated so that the lid and the second ring-shaped member are no longer connected to each other by way of the at least one rupturable second coupling bridge while the lid remains connected to the one of the ring-shaped members by way of the coupling element, the first and second ring-shaped members being configured to remain ring-shaped after the at least one rupturable second coupling bridge is ruptured.

16. The closure assembly according to claim 14, wherein the first ring-shaped member and the second ring-shaped member are coaxial both: i) before the at least one rupturable first coupling bridge and the at least one rupturable second coupling bridge are ruptured; and ii) after the at least one rupturable first coupling bridge and the at least one rupturable second coupling bridge are ruptured.

17. The closure assembly according to claim 14, and further comprising a cutting device configured to rupture and/or pierce and/or cut and/or open a separation membrane of the container.

18. The closure assembly according to claim 14, and further comprising a collar delimiting a pouring outlet;

wherein the first ring-shaped member and the second ring-shaped member are coupled to and surround the collar;

wherein the lid comprises an inner threaded portion and the collar comprises an outer threaded portion;

wherein the inner threaded portion and the outer threaded portion are configured to allow for selectively fastening and loosening the lid on the collar, by respectively screwing and unscrewing action.

19. A container for a pourable product comprising at least one main body being filled or being fillable with the pourable product and at least one closure assembly according to claim 14 and being coupled to the main body.

20. A closure assembly for a container filled or fillable with a pourable product, the closure assembly comprising:

a lid;

a first ring-shaped member;

a second ring-shaped member in overlying relation to the first ring-shaped member, the lid being in overlying relation to the second ring-shaped member;

at least one rupturable first coupling bridge connecting the first ring-shaped member and the second ring-shaped member to one another, the at least one rupturable first coupling bridge being rupturable so that the first ring-shaped member and the second ring-shaped member are disconnected from one another; and at least one rupturable second coupling bridge connecting the second ring-shaped member and the lid to one another, the at least one rupturable second coupling bridge being rupturable so that the lid is movable away from the overlying relation to the second ring-shaped member while the second ring-shaped member remains in the overlying relation to the first ring-shaped member; and the lid being connected to the second ring-shaped member by a coupling element, the coupling element connecting the lid and the second ring-shaped member to each other before the at least one rupturable second coupling bridge is ruptured, after the at least one rupturable second coupling bridge is ruptured and while the lid is being moved away from the overlying relation to the second ring-shaped member.

* * * * *